US009633561B2

(12) United States Patent
Stanek et al.

(10) Patent No.: US 9,633,561 B2
(45) Date of Patent: Apr. 25, 2017

(54) ON-VEHICLE SYSTEM PROVIDING ROADSIDE ASSISTANCE

(71) Applicant: FORD GLOBAL TECHNOLOGIES, LLC, Dearborn, MI (US)

(72) Inventors: Joseph F. Stanek, Northville, MI (US); Lisa Scott, Northville, MI (US); Ramy Boctor, Canton, MI (US); Viet Quoc To, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 426 days.

(21) Appl. No.: 13/940,524

(22) Filed: Jul. 12, 2013

(65) Prior Publication Data

US 2015/0015418 A1 Jan. 15, 2015

(51) Int. Cl.
*G08G 1/0962* (2006.01)

(52) U.S. Cl.
CPC ..... *G08G 1/0962* (2013.01); *G08G 1/09626* (2013.01)

(58) Field of Classification Search
CPC . B60Q 1/26; B60Q 1/46; B60Q 1/525; B60Q 9/008; F21S 10/06; G08B 7/062; G08B 7/066; G08G 1/0962
USPC .... 340/438, 442, 458, 463, 471, 901, 691.1, 340/815.4, 815.45
See application file for complete search history.

(56) References Cited

U.S. PATENT DOCUMENTS

| | | | | |
|---|---|---|---|---|
| 4,807,101 | A | 2/1989 | Milde, Jr. | |
| 4,843,370 | A * | 6/1989 | Milde, Jr. | 340/466 |
| 6,580,364 | B1 * | 6/2003 | Munch et al. | 340/447 |
| 6,759,953 | B2 | 7/2004 | Gilbert et al. | |
| 6,879,251 | B2 | 4/2005 | Robbins et al. | |
| 7,528,707 | B1 * | 5/2009 | Wallace | 340/442 |
| 7,706,967 | B2 | 4/2010 | Knockeart et al. | |
| 8,130,092 | B2 | 3/2012 | Shiraki | |
| 8,376,567 | B1 * | 2/2013 | Zozula | F21S 8/032 315/312 |
| 2004/0233050 | A1 * | 11/2004 | Burghardt | 340/445 |
| 2005/0007246 | A1 * | 1/2005 | Yen et al. | 340/471 |
| 2007/0096892 | A1 | 5/2007 | Nathan et al. | |

(Continued)

FOREIGN PATENT DOCUMENTS

| | | | |
|---|---|---|---|
| CN | 102991419 | A | 3/2013 |
| EP | 1191798 | A1 | 3/2002 |

OTHER PUBLICATIONS

Chinese Patent Office, First Office Action for the corresponding Chinese Patent Application No. 201410331474.4, mailed Jan. 25, 2017.

*Primary Examiner* — Hung T Nguyen
(74) *Attorney, Agent, or Firm* — Frank MacKenzie; Brooks Kushman P.C.

(57) ABSTRACT

One exemplary illustration of a vehicle roadside assistance system may include a sensor at least one of generating and acquiring a detection signal in response to an emergency condition. The system may also have a controller generating an actuation signal based on the detection signal. In addition, the system may also have a computer storage medium storing a plurality of media files indicative of a recommended response to the emergency condition. Moreover, the system may have one or more on-vehicle hazard light devices coupled to the controller and emitting light in response to the actuation signal.

19 Claims, 2 Drawing Sheets

(56) References Cited

U.S. PATENT DOCUMENTS

| | | | | |
|---|---|---|---|---|
| 2008/0074247 | A1* | 3/2008 | Plantamura | 340/438 |
| 2009/0027188 | A1* | 1/2009 | Saban | 340/521 |
| 2009/0233572 | A1 | 9/2009 | Basir | |
| 2010/0162325 | A1* | 6/2010 | Bonar | 725/76 |
| 2013/0044008 | A1 | 2/2013 | Gafford et al. | |

* cited by examiner

ON-VEHICLE SYSTEM PROVIDING ROADSIDE ASSISTANCE

BACKGROUND

On-vehicle systems that facilitate communication between a driver and an agent at a call center are known. Based on this communication, the agent may dispatch assistance to the location of the vehicle in the form of, for example, local emergency responders after a vehicle collision. To that end, the system may include an on-vehicle GPS device that determines the location of the vehicle, particularly when the vehicle occupants are unable to speak and inform the agent of the vehicle location. Of course, the vehicle occupants may, on their own volition, inform the agent of the location of the vehicle, if possible. In addition, these systems may permit vehicle owners to authorize the agent to remotely unlock the vehicle, when the owner inadvertently locks the key inside the vehicle.

The typical systems may also not be configured to automatically actuate hazard lights on the vehicle in response to a predetermined vehicle condition. Typically, the hazard lights may be useful for drawing attention from third party drivers and permit those drivers to cautiously approach the vehicle and any associated road conditions. For at least this reason, it may typically be incumbent on the driver to manually actuate the hazard lights.

These systems may not be configured to provide the vehicle occupants with automated or offline guidance for personally responding to an emergency. In particular, the typical system may require communication with the agent at the call center, who may then provide contact information for a roadside assistance provider that may, for example, repair or tow the vehicle on behalf of the vehicle occupant. In this respect, the system may not instruct a driver on personally handling a vehicle condition or making minor repairs to the vehicle, such as changing a flat tire.

It would therefore be desirable to provide an on-vehicle roadside assistance system that provides roadside assistance to a driver for various vehicle conditions.

SUMMARY

One exemplary illustration of a roadside assistance system for a vehicle may include a sensor, which at least one of generates and acquires a detection signal in response to an emergency condition. In addition, the system may further include a controller generating an actuation signal based on the detection signal. Furthermore, the system may have one or more on-vehicle hazard light devices coupled to the controller and emitting light in response to the actuation signal.

Another exemplary illustration of a roadside assistance system for a vehicle may include a sensor, which may at least one of generate and acquire a detection signal in response to an emergency condition. In addition, the system may have a controller generating a notification signal and an actuation signal based on the detection signal. The system may further include a computer storage medium storing a plurality of media files indicative of a recommended response to the emergency condition. Moreover, the system may have one or more on-vehicle hazard light devices coupled to the controller and emitting light in response to the actuation signal. The system may also have a transceiver coupled to the controller and transmitting the notification signal to a third party vehicle.

DETAILED DESCRIPTION

Figure 1:
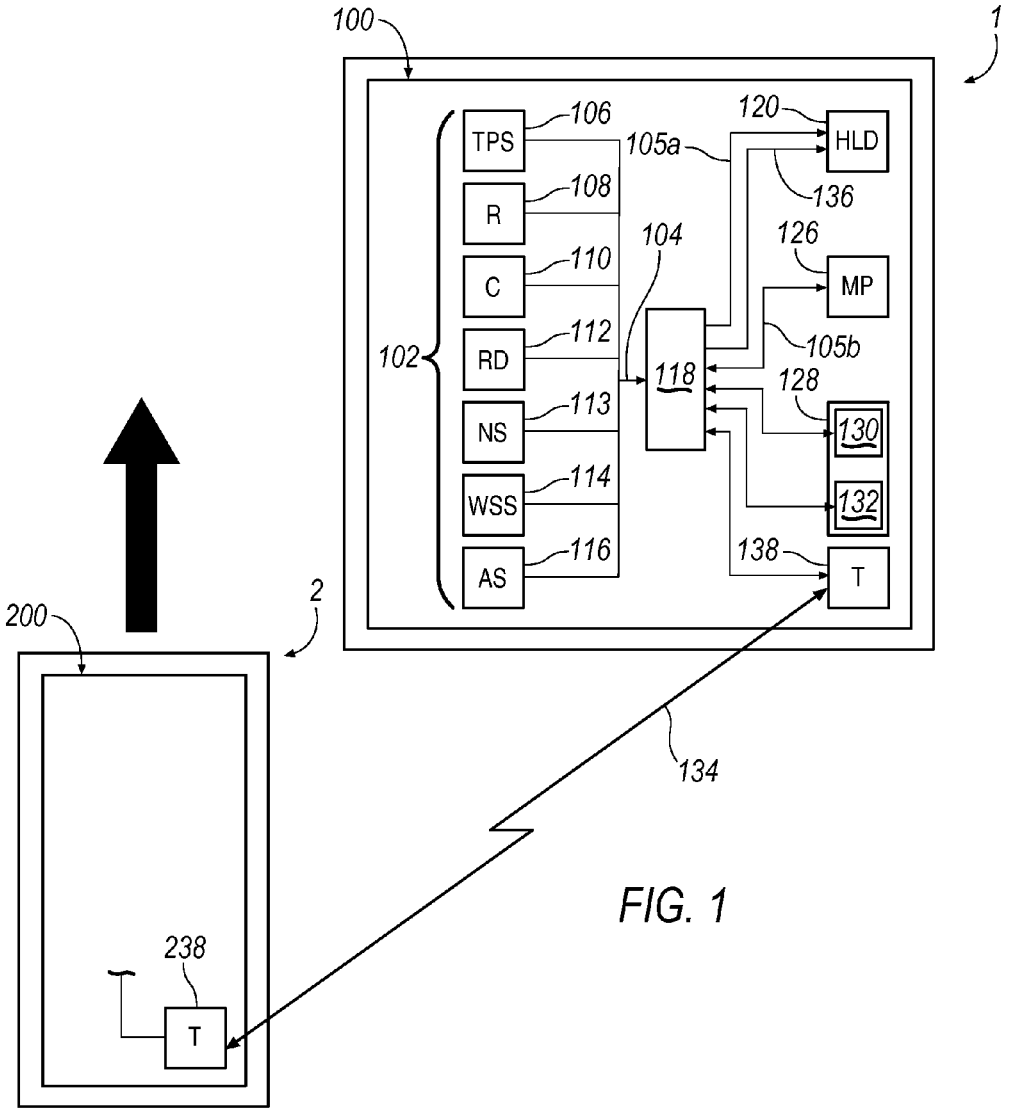
FIG. 1 is a schematic block diagram of a vehicle having one exemplary illustration of a roadside assistance system being implemented in traffic.

Referring now to the discussion that follows and also to the drawings, illustrative approaches are shown in detail. Although the drawings represent some possible approaches, the drawings are schematic in nature and thus not drawn to scale, with certain features exaggerated or removed to better illustrate and explain the present disclosure. Further, the descriptions set forth herein are not intended to be exhaustive or otherwise limit or restrict the claims to the precise forms and configurations shown in the drawings and disclosed in the following detailed description.

An exemplary illustration of a roadside assistance system for a vehicle may include one or more sensors, which at least one of generate and acquire a detection signal in response to an emergency condition. As one example, the sensors may include a receiver that acquires the detection signal, in the form of a GPS signal or other position signal indicative that at least a portion of the vehicle may be located in an emergency lane or on the shoulder of a road. In this example, the sensors may further include a tire pressure sensor generating the detection signal in the form of a tire pressure signal indicative of a flat tire of the vehicle. Further, the sensors may include a neutral safety switch that generates the detection signal, in the form of a safety signal indicative that a vehicle gear shifter is disposed in a park position. The system may also include a controller generating an actuation signal based on the detection signals received from the sensors. Continuing with the previous example, the controller may generate the actuation signal based on the position signal received from the receiver, the tire pressure signal received from the tire pressure sensor and the safety signal received from the neutral safety switch. This system may have one or more on-vehicle hazard light devices coupled to the controller and emitting light in response to the actuation signal. Of course, the system may include any number of suitable sensors that generate or acquire detection signals indicative of various vehicle conditions. In addition, the system may include other devices for responding to the detected vehicle condition, such as a media player for instructing the vehicle occupant on personally responding to the vehicle condition.

Referring to FIG. 1, an exemplary roadside assistance system 100 (hereinafter "system") may include one or more sensors or sensor modules 102, which at least one of generate and acquire a detection signal 104 in response to detecting an emergency condition. As one example, the sensors 102 may include a tire pressure sensor 106 generating a detection signal 104 in the form of a pressure signal. Further, the sensors 102 may include a receiver 108 that acquires the detection signal 104 indicative of a vehicle location, e.g. in an emergency lane, a proximity detection camera 110 generating another detection signal 104 indicative of a proximity of the vehicle to a third party traffic and a radar device 112 generating the detection signal 104 indicative of the vehicle location associated with the third party traffic. By one example, the receiver 108, the camera 110 and the radar device 112 may detect whether a portion of the parked vehicle is protruding into or immediately adjacent to moving traffic. The sensors 102 may further include neutral safety switch 113 generating the detection signal 104 in the form of a safety signal to indicate that a vehicle gear shifter has been moved to a park position. In addition, the sensors 102 may include a wheel speed sensor 114 generating the detection signal 104 in the form of a speed signal that is indicative of a vehicle speed. The sensors 102 may further include an airbag sensor 116 generating the detection signal 104 in the form of a collision signal indicative of a deployment of one or more airbags. Of course, the sensors 102 may include any suitable number of sensors and generate various detection signals 104 indicative of any emergency condition, including but not limited to an engine problem, a vehicle power loss, a fuel depletion, a vehicle collision or other vehicle conditions.

The system 100 may further include a controller 118 generating one or more actuation signals 105*a*, 105*b* based on the detection signals 104 received from the sensors 102. In addition, the system may include one or more on-vehicle hazard light devices 120 coupled to the controller 118 and emitting light in response to receiving the actuation signal 105*a* from the controller 118.

In particular, continuing with the previous example, the controller 118 may receive the tire pressure signal from the tire pressure sensor 106 and determine that the pressure is below a first threshold or a second threshold that is lower than the first threshold. A detected pressure that is below the first threshold may be indicative of a low tire pressure, while a pressure that is below the second threshold may be indicative of a flat or punctured tire. The controller 118 may generate the actuation signal based at least in part on the tire pressure being below the first or second threshold. In addition, the controller 118 may further generate the actuation signal 105*a* based in part on detection signals 104, which are received from the receiver 108, the proximity detection camera 110 and the radar device 112. These detection signals 104 may be indicative that at least a portion of the vehicle is located in an emergency lane and within a predetermined distance of traffic. Moreover, the controller 118 may generate the actuation signal 105*a* in further response to receiving the safety signal indicative that the gear shifter is disposed in the parked position. In this example, the controller 118 may generate the actuation signal based on one or more of these detection signals 104, such that the hazard light devices 120 may receive the actuation signal 105*a* and automatically emit light in response to the actuation signal. In this respect, the system may automatically actuate the hazard light devices 120 when the vehicle has a low tire pressure and is at a complete stop within an emergency lane adjacent to traffic. However, the controller 118 may generate another actuation signal 105*b*, which is received by a media player 126 to play one of the media files and/or request a user to manually actuate the hazard light device 120, in response to the controller 118 receiving the detection signal 104, such as a signal indicative that the tire pressure is low but the tire is not completely flat or completely blown. The media player 126 may be a video player, an audio player or any suitable multimedia player.

The system 100 may further include a computer storage medium 128 storing a lookup table 130 of a plurality of reference responses and associated reference detection signals that may be matched with the detection signal 104. The reference responses may be indicative of a recommended user action for an occupant of the vehicle handling the related emergency condition. In this example, the storage medium 128 may store a plurality of media files indicative of the recommended responses to the associated emergency conditions. The media files may be video files, audio files, multimedia files, image files, other suitable files or any combination thereof.

Furthermore, the computer storage medium 128 may store another lookup table 132, which contains a plurality of reference notification signals and associated reference detection signals that may be matched with the detection signal 104. The reference notification signals may be indicative of one or more emergency conditions of the original vehicle, a vehicle location and a recommended traffic maneuver, such as a recommendation for approaching traffic to change lanes away from the location of the vehicle 1 that generated the notification signal. In one example, the controller 118 may access the lookup tables 130, 132 and identify a media file and a notification signal associated with one or more detection signals 104 received from the sensors 102. This computer readable medium and all signals are non-transitory, including all computer-readable media, with the sole exception being a transitory propagating signal per se.

The system may also include an on-vehicle media player 126 to inform a vehicle occupant on how to personally respond to a vehicle condition in response to receiving the actuation signal. In particular, the media player 126 can play the media file associated with the recommended response and the actuation signal. Continuing with the previous example, the media player 126 can play the media file to notify a user of a low tire pressure condition and prompt manual actuation of the hazard light devices 120. The media player 126 can also play the media file to display a recommended tire repair method or contact information for an auto repair business, an insurance carrier, a towing business, a public safety agency or any combination of the same.

The controller 118 may be configured to generate a deactivation signal 136 in response to receiving a detection signal 104 from one or more sensors 102 indicating that the emergency condition has expired. The hazard light devices 120 may receive the deactivation signal 136 and cease emitting light in response to receiving the deactivation signal 136 from the controller 118. In particular, the controller 118 may generate the deactivation signal 136. As one example, the controller 118 may receive the detection signal in the form of a tire pressure signal indicative that the tire pressure is above the first and second thresholds, which may indicate that the low or flat tire has been repaired. By way of another example, the controller 118 may receive detection signals 104 from the receiver 108, which indicates that the vehicle 1 is re-entering a street from an emergency lane.

The system 100 may also include a transceiver 138 coupled to the controller 118 for transmitting the notification signal 134 from the controller 118 to a third party vehicle 2 (FIG. 1). In particular, the third party vehicle 2 may have a roadside assistance system 200, which is substantially similar to the system 100 and has similar elements identified with reference numerals in the 200 series. In particular, the system 200 may have a transceiver 238 receiving the notification signal 134 from the system 100, so as to inform the third party driver of the condition and location of the vehicle 1, and further recommend a maneuver, such as changing lanes away from the vehicle 1.

Figure 2:
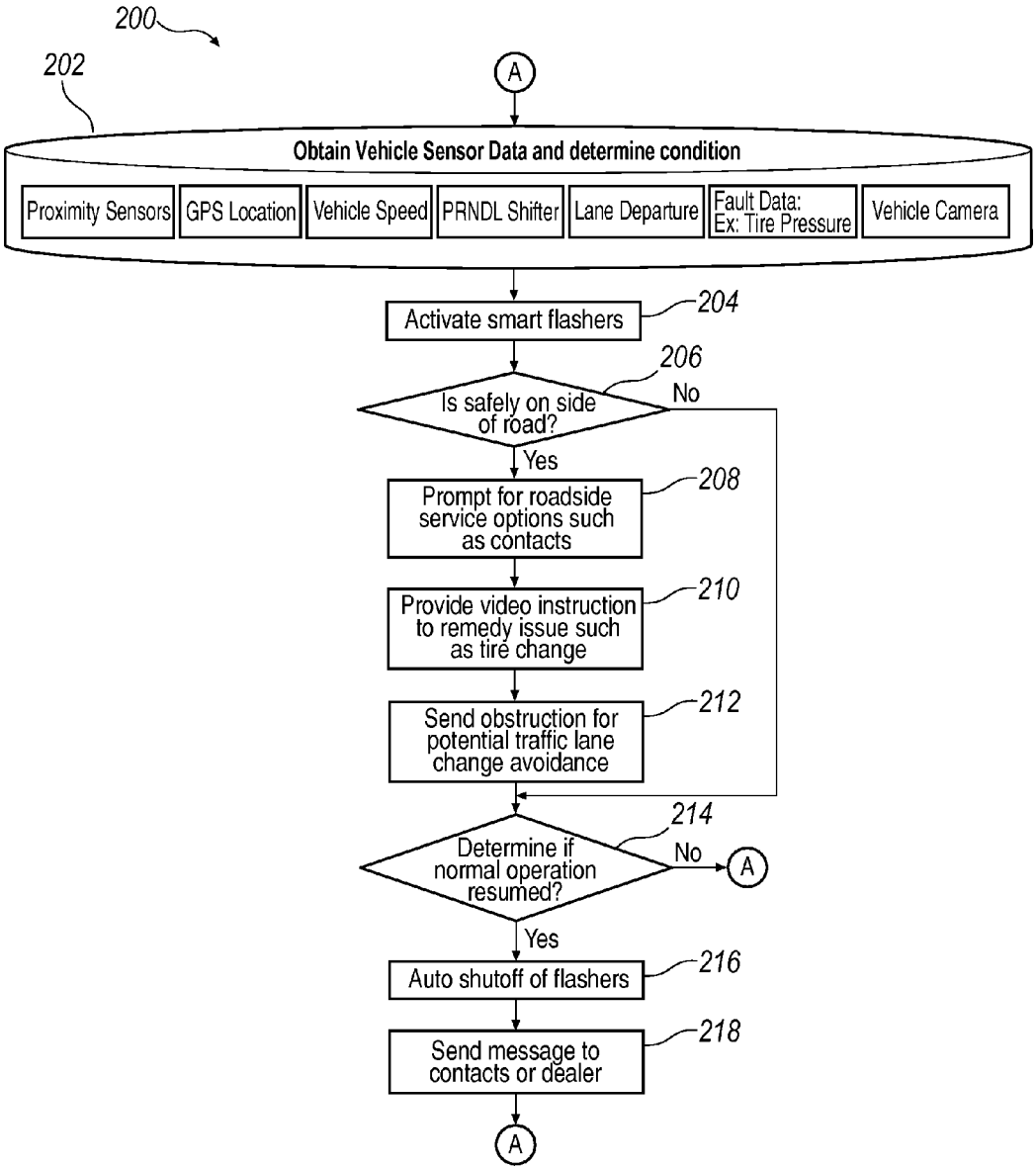
FIG. 2 is a flow chart depicting one exemplary method of providing roadside assistance to a vehicle occupant operating the system of FIG. 1.

Referring now to FIG. 2, there is illustrated one exemplary method 200 for operating the system 100 of FIG. 1 to provide roadside assistance to a vehicle occupant. At step 202, one or more detection signals 104 may be generated or acquired by one or more sensors 102, in response to detecting an emergency condition. For example, this step may be accomplished by the tire pressure sensor 106 generating the pressure signal indicative of a low or flat tire condition. This step may be also accomplished by multiple sensors detecting lane departure or a portion of a vehicle being parked in an emergency lane while protruding into or being immediately adjacent to moving traffic. To that end, for example, this step may be accomplished by the receiver 108 acquiring the detection signal 104 indicative of a vehicle location, the proximity detection camera 110 generating another detection signal 104 indicative of the proximity of the vehicle to third party traffic and the radar device 112 generating the detection signal 104 indicative of the vehicle being located within a predetermined distance of third party traffic. This step may be further accomplished by the neutral safety switch 113 generating the detection signal indicative of the vehicle gear shifter being moved to the park position. In addition, the wheel speed sensor 114 may generate the speed signal indicative of a stationary vehicle. In addition, the airbag sensor 116 may generate the collision signal indicative of deployment of one or more airbags during a vehicle collision. Of course, the sensors 102 may include any suitable number of sensors and generate various detection signals 104 indicative of any emergency condition, including but not limited to an engine problem, a vehicle power loss, a fuel depletion, a vehicle collision or other vehicle conditions.

At step 204, the controller 118 may generate the actuation signal based on the detection signals 104, and the hazard light devices 120 may emit light in response to the actuation signal. In one example, the controller 118 may close a switch so as to provide an electrical current to the light devices 120.

At step 206, the controller 118 may determine whether the vehicle is safely located on the side of the road to permit the vehicle occupants to, for example, call for roadside assistance or receive instructions on responding to the emergency condition. To that end, the controller 118 may receive multiple detection signals 104 from one or more sensors 102 to indicate the location of the vehicle. By one example, the controller 118 may receive the speed signal from the wheel speed sensor 114, and the speed signal may be indicative that the vehicle is not moving. Further, the controller 118 may also receive a position signal from the receiver 108, and the position signal may indicate that at least a portion of the vehicle is parked in the emergency lane. The controller 118 may further receive the detection signal 104 from the neutral safety switch 113, and the detection signal 104 may be indicative of the gear shifter being disposed in the park position. Of course, this step may be accomplished by any combination of these mechanisms and related functions or by other suitable approaches.

At step 208, the media player 126 may receive the actuation signal from the controller 118 and prompt the vehicle occupant to take any one of a number of predetermined roadside service options. By one example, the controller 118 may access a reference lookup table 130 and determine a recommended response to an emergency condition, by matching the detection signal 104 with one of the plurality of reference detection signals stored in the lookup table 130 and identifying the recommended response that is associated with the reference detection signal. In particular, as just one example, a reference detection signal, which indicates a complete depletion of fuel, may be associated with a recommended response in the form of a media file, which is played by the media player 126 and provides contact information for the closest gas station, a local police station and a towing service. In other examples, the system may provide contact information for other entities, such as contact information for at least one of an auto repair business, an insurance carrier, and any public safety agency.

At step 210, the media player 126 may play the media file associated with the detection signal 104. This step may be accomplished by the controller 118 accessing the computer storage medium 128 and identifying the media file indicative of a recommended response to the emergency condition based on the detection signal 104. The media player 126 may receive the actuation signal from the controller 118, and play the media file to provide instructions on responding to the emergency condition. For example, the controller 118 may generate an actuation signal in response to a detection signal 104 indicative of a flat tire, and the media player 126 may receive the actuation signal from the controller 118 and play a media file that provides video instructions on changing a tire. Of course, this step may be accomplished by playing media files providing instructions for responding to other emergency conditions.

At step 212, the controller 118 may transmit a notification signal to the system 200 of the third party vehicle 2. For example, the controller 118 may select the notification signal 134 from the lookup table 132 based on detection signals 104 received from sensors 102, and then transmit the notification signal 134 from the transceiver 138 to the transceiver 238 of the other vehicle 2. The notification signal 134 may indicate the location and condition of the vehicle 1, and recommend a traffic maneuver for the third party vehicle 2, such as a lane change away from the vehicle or a decrease in speed. The controller 118 of the system 200 may then select a media file from a lookup table 130 based on the detection signal 104, and then generate the actuation signal received by the media player 126 to play the media file and communicate the location and condition of the vehicle and any recommended traffic maneuvers.

At step 214, the system 100 may determine whether normal operation of the vehicle has been resumed. For example, this step may be accomplished by the controller 118 receiving a position signal, speed signal and safety signal from the receiver 108, the wheel speed sensor 114 and the neutral safety switch 113, so as to indicate that the vehicle is re-entering the road from an emergency lane. However, this step may be accomplished by other suitable detection and analysis methods. If normal operation is resumed, the method may proceed to step 216. If not, the method may return to step 204.

At step 216, the controller 118 generates a deactivation signal 136, indicative that the emergency condition has terminated. The hazard light devices 120 may terminate emitting light in response to the deactivation signal 136.

At step 218, the system 100 in this example may send a message to one or more vehicle assistance providers. For example, if the controller 118 determines an engine power loss based on the detection signal 104, then the controller 118 may generate a message signal transmitted through the transceiver 138 for receipt by an auto repair business. This message may include information on the vehicle or the parts or systems requiring repair, to facilitate repair of the vehicle.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be apparent upon reading the above description. The scope of the invention should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the invention is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

What is claimed as new and desired to be protected by Letters Patent of the United States is:

1. A vehicle roadside assistance system, comprising:

a sensor outputting a detection signal in response to an emergency condition;

a controller generating an actuation signal based on the detection signal; and at least one on-vehicle hazard light device coupled to the controller and emitting light in response to the actuation signal; and an on-vehicle media player configured to, in response to the actuation signal, play a media file indicative of a recommended response to the emergency condition.

2. The vehicle roadside assistance system of claim 1, wherein the sensor is at least one of:

a receiver acquiring the detection signal indicative of a vehicle location;

a proximity detection camera generating the detection signal indicative of a proximity of the vehicle to a third party traffic;

a radar device generating the detection signal indicative of the vehicle location associated with the third party traffic; and an airbag sensor generating the detection signal indicative of a deployment of an airbag.

3. The vehicle roadside assistance system of claim 1, wherein the sensor is a tire pressure sensor operably coupled to at least one tire of the vehicle and generating the detection signal indicative of a tire pressure of the at least one tire, and the controller generates the actuation signal based on the tire pressure being below a first threshold.

4. The vehicle roadside assistance system of claim 3, wherein the media player plays the media file to notify a user of a low tire pressure condition and a flat tire condition.

5. The vehicle roadside assistance system of claim 3, wherein the controller generates the actuation signal based on the tire pressure being below a second threshold that is lower than the first threshold.

6. The vehicle roadside assistance system of claim 5, wherein the media player plays the media file for communicating at least one of:

a recommended tire repair method; and a contact information for at least one of an auto repair business, an insurance carrier, a towing business and a public safety agency.

7. The vehicle roadside assistance system of claim 1, further comprising a neutral safety switch generating a safety signal indicative of a vehicle gear shifter being moved to a park position, and the controller generates the actuation signal in response to receiving the safety signal.

8. The vehicle roadside assistance system of claim 1, further comprising a wheel speed sensor generating a speed signal indicative of a vehicle speed, and the controller generates the actuation signal in response to receiving the speed signal that is indicative of the vehicle speed being zero.

9. The vehicle roadside assistance system of claim 1, wherein the detection signal is indicative of at least one of an engine problem, a vehicle power loss, a fuel depletion and a vehicle collision.

10. The vehicle roadside assistance system of claim 1, wherein the controller generates a deactivation signal indicative that the emergency situation terminated.

11. The vehicle roadside assistance system of claim 10, wherein the hazard light devices terminate emitting light in response to the deactivation signal.

12. A vehicle roadside assistance system, comprising:

a sensor at least one of generating and acquiring a detection signal in response to an emergency condition;

a controller generating a notification signal and an actuation signal based on the detection signal;

a computer storage medium storing a plurality of media files indicative of a recommended response to the emergency condition;

an on-vehicle media player configured to, in response to the actuation signal, play one of the media files associated with the actuation signal;

at least one on-vehicle hazard light device coupled to the controller and emitting light in response to the actuation signal; and a transceiver coupled to the controller and transmitting the notification signal to a third party vehicle.

13. The vehicle roadside assistance system of claim 12, wherein the computer storage medium stores a lookup table of a plurality of reference responses associated with a plurality of reference detection signals, and the reference responses are indicative of a recommended user action for an occupant of the vehicle.

14. The vehicle roadside assistance system of claim 12, wherein the computer storage medium stores a lookup table of reference notification signals associated with a plurality of reference detection signals, and the reference notification signals are indicative of a recommended third party action by a third party occupant of the third party vehicle.

15. The vehicle roadside assistance system of claim 12, wherein the notification signal is indicative of at least one of the emergency condition of the vehicle, the recommended user action and the recommended third party action.

16. The vehicle roadside assistance system of claim 15, wherein the notification signal is indicative of a location of at least one of:

a vehicle location; and a lane change suggestion.

17. The vehicle roadside assistance system of claim 12, wherein the controller actuates the media player to play one of the media files and request a user to manually actuate the at least one hazard light device, in response to the controller receiving the detection signal.

18. The vehicle roadside assistance system of claim 12, wherein the detection signal is indicative of at least one of an engine problem, a vehicle power loss, a fuel depletion and a vehicle collision.

19. A method of providing roadside assistance for a vehicle occupant, comprising:

outputting, by a sensor, a detection signal in response to an emergency condition;

generating, by a controller, an actuation signal based on the detection signal;

playing, by an on-vehicle media player, a stored media file in response to the actuation signal; and emitting light from at least one on-vehicle hazard light device coupled to the controller and in response to the actuation signal.

* * * * *